US011396880B2

(12) United States Patent
Takemoto et al.

(10) Patent No.: US 11,396,880 B2
(45) Date of Patent: Jul. 26, 2022

(54) INLINE AXIAL FLOW FAN

(71) Applicant: Nidec Corporation, Kyoto (JP)

(72) Inventors: Shinji Takemoto, Kyoto (JP); Kosuke Mizuike, Kyoto (JP); Yoshitsugu Sasaguri, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 53 days.

(21) Appl. No.: 16/668,095

(22) Filed: Oct. 30, 2019

(65) Prior Publication Data

US 2020/0149537 A1 May 14, 2020

(30) Foreign Application Priority Data

Nov. 8, 2018 (JP) ..... JP2018-210792

(51) Int. Cl.
*F04D 19/00* (2006.01)
*F04D 29/52* (2006.01)
*F04D 19/02* (2006.01)

(52) U.S. Cl.
CPC ..... *F04D 19/007* (2013.01); *F04D 19/024* (2013.01); *F04D 29/522* (2013.01)

(58) Field of Classification Search
CPC ..... F04D 19/002; F04D 19/007; F04D 29/52; F04D 29/522
See application file for complete search history.

(56) References Cited

U.S. PATENT DOCUMENTS 7,872,381 B2 * 1/2011 Watanabe ..... F04D 19/007 310/58
7,942,627 B2 * 5/2011 Jin ..... F04D 19/007 415/66
7,946,804 B2 5/2011 Koshida
8,047,803 B2 * 11/2011 Yamada ..... G06F 1/20 416/238
8,226,350 B2 * 7/2012 Hayashigaito ..... F04D 29/526 415/66
8,740,562 B2 6/2014 Takemoto et al.
(Continued)

FOREIGN PATENT DOCUMENTS

CN 1751184 A 3/2006
CN 200978834 Y 11/2007
(Continued)

OTHER PUBLICATIONS

Official Communication issued in corresponding Chinese Patent Application No. 201911081113.8, dated Oct. 30, 2020.
(Continued)

*Primary Examiner* — Brian P Wolcott
*Assistant Examiner* — Jackson N Gillenwaters
(74) *Attorney, Agent, or Firm* — Keating & Bennett

(57) ABSTRACT

An inline axial flow fan includes a first fan including a first impeller, a first motor portion, and a first case, and a second fan including a second impeller, a second motor portion, and a second case, the first fan and the second fan being positioned in sequence from one axial side to another axial side. The first case includes multiple first slits, and the second case includes multiple second slits. The inline axial flow fan includes a flange extending radially outward from an outer peripheral surface of the first case or the second case located between the first slit and the second slit in the axial direction.

7 Claims, 5 Drawing Sheets

(56) References Cited

U.S. PATENT DOCUMENTS

| | | | | |
|---|---|---|---|---|
| 8,882,455 | B2 * | 11/2014 | Takemoto | F04D 29/646 415/186 |
| 2008/0260517 | A1 | 10/2008 | Hayashigaito et al. | |
| 2012/0026688 | A1 * | 2/2012 | Takemoto | F04D 29/582 361/695 |
| 2016/0131160 | A1 | 5/2016 | Bai et al. | |
| 2018/0070473 | A1 * | 3/2018 | Zhang | H05K 7/20181 |
| 2018/0100518 | A1 * | 4/2018 | Sun | F04D 19/007 |
| 2018/0195525 | A1 * | 7/2018 | Hakozaki | F04D 29/384 |

FOREIGN PATENT DOCUMENTS

| | | | |
|---|---|---|---|
| CN | 102345643 | A | 2/2012 |
| CN | 104454587 | A | 3/2015 |
| CN | 207131611 | U | 3/2018 |
| CN | 108302052 | A | 7/2018 |
| JP | 2004-278371 | A | 10/2004 |
| SU | 926369 | A1 | 5/1982 |

OTHER PUBLICATIONS

Official Communication issued in corresponding Chinese Patent Application No. 201911081100.0 dated Oct. 10, 2020.
Takemoto et al., "Inline Axial Flow Fan", U.S. Appl. No. 16/668,099, filed Oct. 30, 2019.
Official Communication issued in corresponding Chinese Patent Application No. 201911081100.0, dated Dec. 14, 2021.

* cited by examiner

INLINE AXIAL FLOW FAN

CROSS REFERENCE TO RELATED APPLICATION

The present application claims priority under 35 U.S.C. § 119 to Japanese Application No. 2018-210792 filed on Nov. 8, 2018 the entire contents of which are hereby incorporated herein by reference.

1. FIELD OF THE INVENTION

The present disclosure relates to an inline axial flow fan.

2. BACKGROUND

Conventionally, an inline axial flow fan has been known in which two axial air blow units are connected in series along a predetermined central axis.

SUMMARY

According to one example embodiment of the present disclosure, an inline axial flow fan includes a first fan including a first impeller that is rotatable about a central axis, a first motor portion that rotates the first impeller, and a first case that surrounds an outer periphery of the first impeller, and a second fan including a second impeller that is rotated about a central axis, a second motor portion that rotates the second impeller, and a second case that surrounds an outer periphery of the second impeller, the first fan and the second fan being positioned in sequence from one axial side to another axial side. The first case includes multiple first slits located radially outward of the first impeller. The second case includes multiple second slits located radially outward of the second impeller. The inline axial flow fan includes a flange extending radially outward from an outer peripheral surface of the first case or the second case located between the first slit and the second slit in the axial direction.

The above and other elements, features, steps, characteristics and advantages of the present disclosure will become more apparent from the following detailed description of the example embodiments with reference to the attached drawings.

DETAILED DESCRIPTION

In each of the drawings, the Z-axis direction is a vertical direction in which the positive side is the upper side and the negative side is the lower side. The axial direction of a central axis J, which is a virtual axis appropriately shown in each drawing, is parallel to the Z-axis direction, that is, the vertical direction. In the following description, if not explicitly stated otherwise, a direction parallel to the axial direction of the central axis J is simply referred to as "axial direction", a radial direction centered on the central axis J is simply referred to as "radial direction", and a circumferential direction centered on the central axis J is simply referred to as "circumferential direction".

In the example embodiment, the lower side corresponds to one axial side and the upper side corresponds to the other axial side. Note that the upper side and the lower side are simply terms for explaining the relative positional relationship among the parts, and the actual positional relationship and the like may be a positional relationship or the like referred to by different terms.

Figure 1:
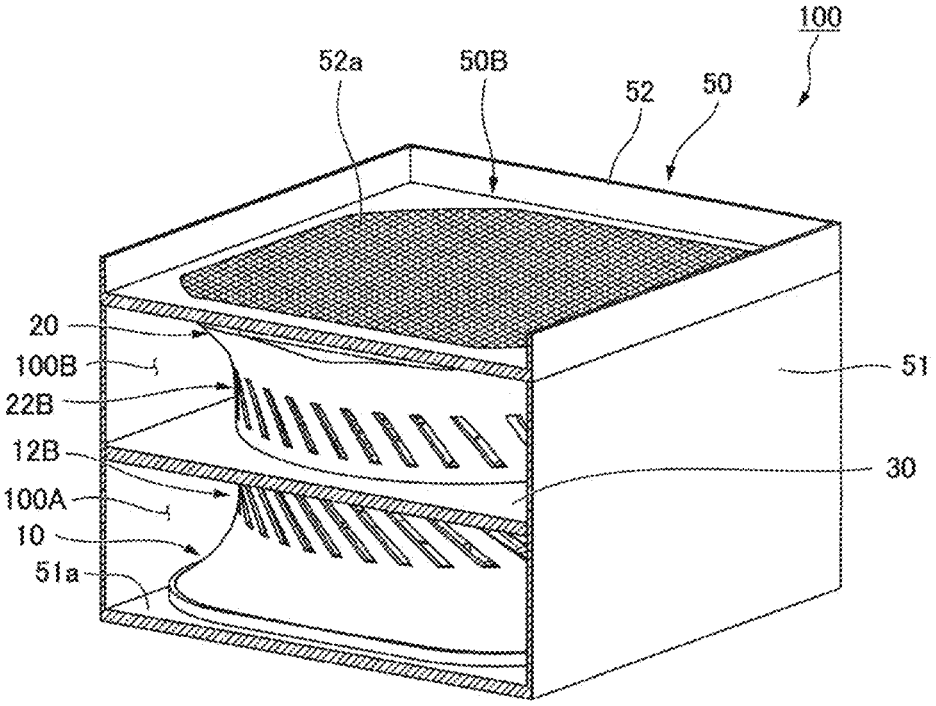
FIG. 1 is a perspective view including a partial cross section showing an inline axial flow fan of an example embodiment of the present disclosure.
Figure 2:
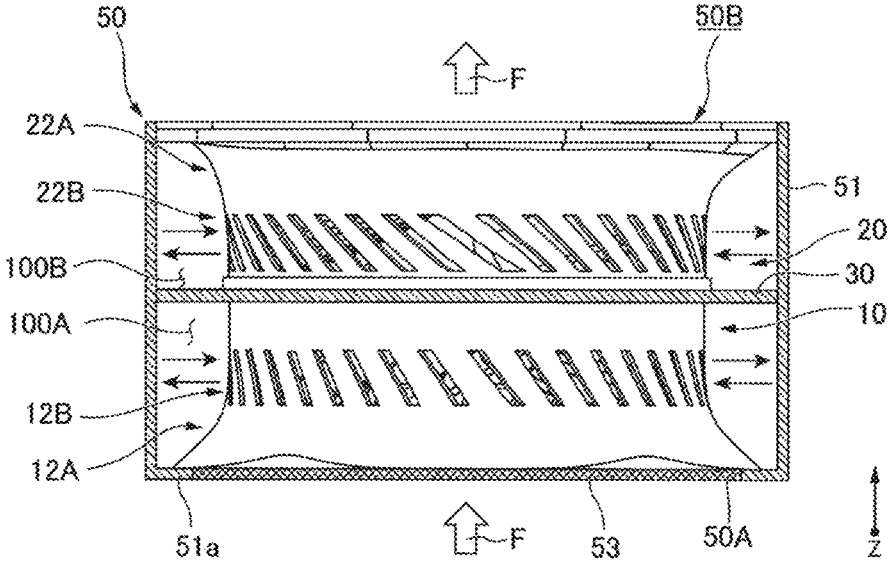
FIG. 2 is a side view including a partial cross section of the inline axial flow fan of an example embodiment of the present disclosure.
Figure 3:
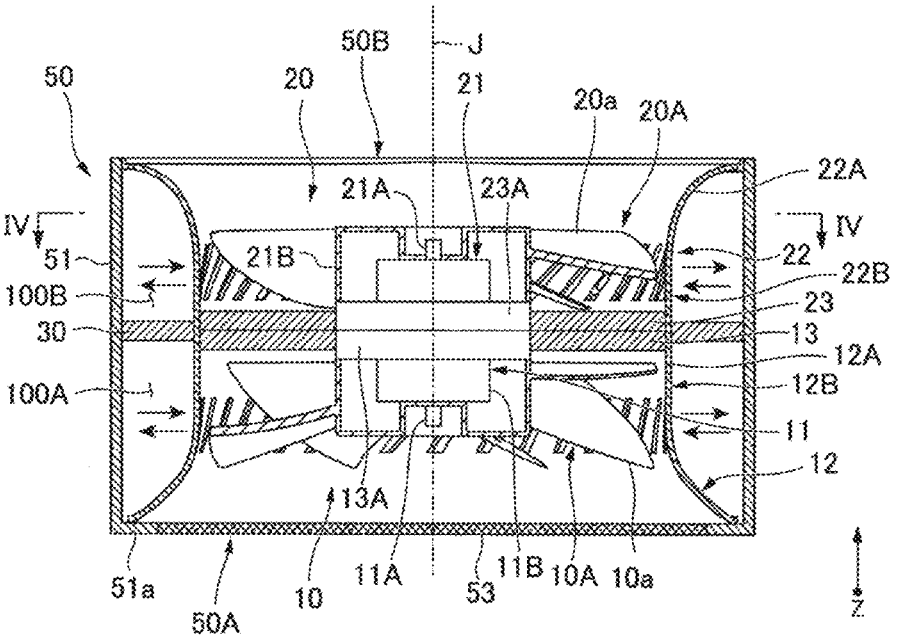
FIG. 3 is a cross-sectional view of the inline axial flow fan of an example embodiment of the present disclosure.

FIG. 1 is a perspective view including a partial cross section showing an inline axial flow fan of the example embodiment. FIG. 2 is a side view including a partial cross section of the inline axial flow fan of the example embodiment. FIG. 3 is a cross-sectional view of the inline axial flow fan of the example embodiment.

An inline axial flow fan 100 of the example embodiment is used as a blower of an air cleaner, for example.

As shown in FIG. 1, the inline axial flow fan 100 includes a first fan 10, a second fan 20, a flange 30, and a housing 50. The housing 50 is a rectangular tube-shaped casing that is open to upper and lower sides. The first fan 10 is accommodated in a lower part of the housing 50. The second fan 20 is accommodated in an upper part of the housing 50. The first fan 10 and the second fan 20 are disposed in sequence along the axial direction from one axial side to the other axial side. The flange 30 is a plate-like member that extends radially outward from an intermediate position in the axial direction between the first fan 10 and the second fan 20 inside the housing 50.

The inline axial flow fan 100 sucks in air from a lower surface of the housing 50 and injects the air from an upper surface of the housing 50. In the inline axial flow fan 100, the first fan 10 is disposed on the intake side, and the second fan 20 is disposed on the exhaust side.

As illustrated in FIGS. 2 and 3, the first fan 10 includes a first impeller 10A, a first motor portion 11, a first case 12, and multiple first support ribs 13.

The first impeller 10A has multiple first blades 10*a* disposed radially at a constant pitch around the central axis J. The first impeller 10A is rotated about the central axis J in a predetermined direction by the first motor portion 11. While the number of first blades 10*a* in the first impeller 10A is seven in the example embodiment, this can be changed according to the design of the inline axial flow fan 100.

The first case 12 is a cylindrical casing that surrounds the radially outer side of the first impeller 10A. The first case 12 is made of resin or metal, for example. The first case 12 includes a cylindrical peripheral wall portion 12A extending in the axial direction, and multiple first slits 12B penetrating the peripheral wall portion 12A in the radial direction.

Each of the first slits 12B extends in a direction intersecting the central axis J when viewed from the radial direction. The longitudinal direction of the first slit 12B intersects the ridgeline of the outer peripheral edge in the radial direction of the first blade 10*a* at an angle of approximately 90 degrees. The multiple first slits 12B extend in directions parallel to one another. The multiple first slits 12B are arranged at regular intervals in a region that is one lap in the circumferential direction of the peripheral wall portion 12A.

The first case 12 forms a passage of an airflow F by an inner peripheral surface of the peripheral wall portion 12A.

In the case of the example embodiment, a lower end portion of the peripheral wall portion 12A that is the intake side of the first fan 10 has a shape that expands radially toward the lower side. In the peripheral wall portion 12A, the part accommodating the first impeller 10A and above is cylindrical.

Multiple first support ribs 13 are disposed in an upper opening of the peripheral wall portion 12A. The first fan 10 of the example embodiment has four first support ribs 13. The multiple first support ribs 13 extend radially about the central axis J. A radially outer end portion of the first support rib 13 is connected to the inner peripheral surface of the peripheral wall portion 12A. A radially inner end portion of the first support rib 13 is connected to a motor support portion 13A that supports the first motor portion 11.

As shown in FIG. 3, the first motor portion 11 is attached to a lower surface of the motor support portion 13A. In the example embodiment, the first motor portion 11 is an inner rotor type motor. The first motor portion 11 has a shaft 11A centered on the central axis J. The shaft 11A extends downward from a motor case 11B of the first motor portion 11. The first impeller 10A is fixed to a lower end portion of the shaft 11A. The first motor portion 11 may be an outer rotor type motor.

The second fan 20 includes a second impeller 20A, a second motor portion 21, a second case 22, and multiple second support ribs 23.

The second impeller 20A has multiple second blades 20*a* disposed radially at a constant pitch around the central axis J. The second impeller 20A is rotated about the central axis J in the same direction as that of the first impeller 10A by the second motor portion 21. As a result, the second impeller 20A generates an airflow in the same direction as that of the airflow generated by the first impeller 10A. That is, both the first impeller 10A and the second impeller 20A cause an airflow from the lower side to the upper side. While the number of second blades 20*a* in the second impeller 20A is five in this example embodiment, this can be changed according to the design of the inline axial flow fan 100.

The second case 22 surrounds the radially outer side of the second impeller 20A. The second case 22 has a cylindrical peripheral wall portion 22A extending in the axial direction, and multiple second slits 22B penetrating the peripheral wall portion 22A in the radial direction.

Each of the second slits 22B extends in a direction intersecting the central axis J when viewed from the radial direction. The longitudinal direction of the second slit 22B intersects the ridgeline of the outer peripheral edge in the radial direction of the second blade 20*a* at an angle of approximately 90 degrees. The multiple second slits 22B extend in directions parallel to one another. The multiple second slits 22B are arranged at regular intervals in a region that is one lap in the circumferential direction of the peripheral wall portion 22A.

The second case 22 forms a passage of the airflow F by an inner peripheral surface of the peripheral wall portion 22A. In the case of the example embodiment, an upper end portion of the peripheral wall portion 22A that is the exhaust side of the second fan 20 has a shape that expands radially toward the upper side. In the peripheral wall portion 22A, the portion accommodating the second impeller 20A and below is cylindrical.

Multiple second support ribs 23 are disposed in a lower opening of the peripheral wall portion 22A. The second fan 20 of the example embodiment has four second support ribs 23. The multiple second support ribs 23 extend radially about the central axis J. A radially outer end portion of the second support rib 23 is connected to the inner peripheral surface of the peripheral wall portion 22A. A radially inner end portion of the second support rib 23 is connected to a motor support portion 23A that supports the second motor portion 21.

The second motor portion 21 is attached to an upper surface of the motor support portion 23A. In the example embodiment, the second motor portion 21 is an inner rotor type motor. The second motor portion 21 has a shaft 21A centered on the central axis J. The shaft 21A extends upward from a motor case 21B of the second motor portion 21. The second impeller 20A is fixed to an upper end portion of the shaft 21A. The second motor portion 21 may be an outer rotor type motor.

As shown in FIG. 3, the first fan 10 and the second fan 20 are disposed next to one another in the axial direction with the upper opening of the peripheral wall portion 12A and the lower opening of the peripheral wall portion 22A abutting each other. The inner diameter of the peripheral wall portion 12A and the inner diameter of the peripheral wall portion 22A are the same, and the peripheral wall portion 12A and the peripheral wall portion 22A form one passage that is continuous in the axial direction.

The motor support portion 13A of the first fan 10 and the motor support portion 23A of the second fan 20 are disposed so as to overlap one another in axial view. The multiple first support ribs 13 of the first fan 10 and the multiple second support ribs 23 of the second fan 20 are disposed so as to overlap at least partially in axial view. Air flows in the axial direction through a gap between the first support ribs 13 adjacent in the circumferential direction and a gap between the second support ribs 23 adjacent in the circumferential direction.

The housing 50 has a rectangular tube-shaped main body portion 51 having a bottom wall portion 51*a* and extending in the vertical direction, an upper lid portion 52 attached to the upper side of the main body portion 51, and an air filter 53 attached to the lower side of the main body portion 51.

The main body portion 51 has a first opening 50A open to the lower side and a second opening 50B open to the upper side. That is, the housing 50 has the first opening 50A on one axial side and the second opening 50B on the other axial side, and the air filter 53 is attached to the first opening 50A. By providing the air filter 53 and the main body portion 51, it is possible to prevent entry of wind that has not passed through the air filter 53. As a result, the inline axial flow fan 100 can be easily used as a blower for an air cleaner. Note that when the airflow F of the inline axial flow fan 100 is headed downward, the air filter 53 is attached to the upper second opening 50B.

The first fan 10 and the second fan 20 are accommodated in the main body portion 51 of the housing 50. As shown in FIGS. 1 to 3, the flat plate-like flange 30 that extends radially outward from the outer peripheral surface of the first case 12 is disposed at an intermediate position in the axial direction between the first fan 10 and the second fan 20.

The flange 30 is a rectangular plate material having a circular through hole that penetrates the flange 30 in the axial direction. An inner peripheral surface of the flange 30 is in contact with the outer peripheral surface of the first case 12. An outer peripheral surface of the flange 30 is in contact with the inner peripheral surface of the main body portion 51. The flange 30 divides, into upper and lower parts, a space surrounded by the inner peripheral surface of the housing 50, and the first case 12 and the second case 22.

In the example embodiment, the flange 30 only needs to be a member that inhibits air flow in the axial direction, and the inner peripheral end and the outer peripheral end of the flange 30 do not necessarily have to be sealed. A slight gap can be formed between an end surface on the inner peripheral side of the flange 30 and the outer peripheral surface of the first case 12, and a slight gap can be formed between an end surface on the outer peripheral side of the flange 30 and the inner peripheral surface of the housing 50. That is, the flange 30 may be configured to partition the space between the first case 12 and the second case 22 and the housing 50 in the axial direction.

While the flange 30 is disposed on the outer peripheral surface of the first case 12 in the example embodiment, the axial position of the flange 30 can be changed. The axial position of the flange 30 can be changed within a range between the upper end of the first slit 12B and the lower end of the second slit 22B. Additionally, multiple flanges 30 may be provided within the above range.

Additionally, the flange 30 may be a member united with the first case 12 or the second case 22. The flange 30 may be a member integrated with the main body portion 51 of the housing 50. The flange 30 may be divided into multiple plate members in the circumferential direction.

The height of the main body portion 51 of the housing 50 coincides with the height of the first fan 10 and the second fan 20 stacked in the axial direction. The lower end of the peripheral wall portion 12A of the first fan 10 is in contact with an upper surface of the bottom wall portion 51*a*. This suppresses air flow in the radial direction between the inside of the housing 50 and the lower opening of the first fan 10. With this configuration, the inline axial flow fan 100 has a space 100A surrounded by the first case 12, the housing 50, and the flange 30, as shown in FIGS. 1 to 3.

The axial position of the upper opening of the second fan 20 coincides with the axial position of the upper opening of the main body portion 51. The upper lid portion 52 is attached to the second opening 50B of the housing 50. A lower surface of the upper lid portion 52 is in contact with the upper end of the peripheral wall portion 22A of the second fan 20 and the upper end of the main body portion 51. This suppresses airflow in the radial direction between the inside of the housing 50, and the upper opening of the second fan 20 and the upper opening of the main body portion 51. With this configuration, the inline axial flow fan 100 has a space 100B surrounded by the second case 22, the housing 50, and the flange 30, as shown in FIGS. 1 to 3.

The upper lid portion 52 has a mesh portion 52*a* in a region located inside the opening of the second fan 20 in axial view. The mesh portion 52*a* has many through holes axially penetrating the upper lid portion 52. The mesh portion 52*a* functions as a finger guard for preventing insertion of fingers into the second fan 20 from the second opening 50B.

In the inline axial flow fan 100 of the example embodiment, the first case 12 has the first slits 12B, and the second case 22 has the second slits 22B. With this configuration, during operation of the first fan 10 and the second fan 20, air can be taken in and out of the spaces 100A and 100B and the inside of the first case 12 and the second case 22 through the first slits 12B and the second slits 22B. That is, the air outside the first case 12 and the second case 22 can be used as a pressure buffer in the respective wind tunnels of the first fan 10 and the second fan 20. As a result, in each of the first fan 10 and the second fan 20, the pressure inside the wind tunnel is easily maintained within an appropriate range. Hence, it is possible to suppress generation of noise due to pressure fluctuation inside the wind tunnel.

Additionally, the flange 30 divides the space between the first case 12 and the second case 22 and the housing 50 into the two spaces 100A and 100B in the axial direction. Accordingly, in the second fan 20 on the exhaust side, air discharged to the space 100B from the second slits 22B is not sucked into the wind tunnel from the first slits 12B of the first fan 10 on the intake side. When the air discharged from the second slits 22B is sucked in from the first slits 12B, circulating air that does not contribute to the airflow F of the inline axial flow fan 100 is generated in the housing 50, and the static pressure of the inline axial flow fan 100 decreases. By providing the flange 30 in the inline axial flow fan 100, it is possible to suppress decrease in static pressure due to the provision of the first slits 12B and the second slits 22B. Hence, according to the example embodiment, the inline axial flow fan 100 that achieves both low noise and high static pressure is provided.

In the example embodiment, the housing 50 has a rectangular tube shape extending in the axial direction, and the first case 12 and the second case 22 are cylindrical at least in a part from the first slits 12B to the second slits 22B in the axial direction. According to this configuration, an inline axial flow fan with higher static pressure can be obtained. Hereinafter, a description will be given with reference to FIG. 4.

Figure 4:
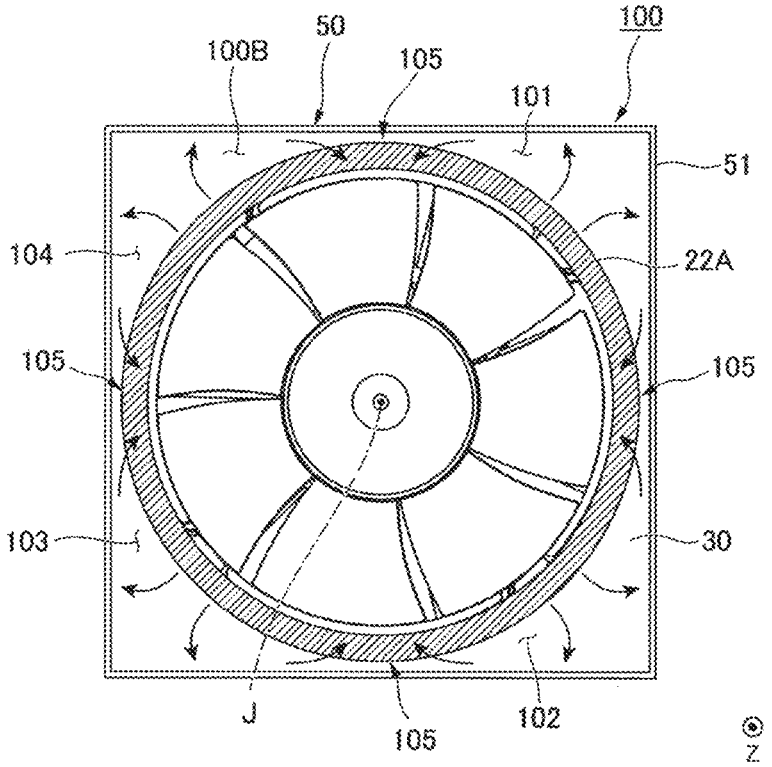
FIG. 4 is a cross-sectional view taken along line IV-IV of FIG. 3.

FIG. 4 is a cross-sectional view taken along line IV-IV shown in FIG. 3.

As shown in FIG. 4, the radial gap between the cylindrical second case 22 and the rectangular tube-shaped main body portion 51 is wide at the corner of the main body portion 51 and narrow at the center of the sidewall of the main body portion 51. The position where the outer peripheral surface of the second case 22 and the inner peripheral surface of the main body portion 51 come closest is a narrow portion 105 where the air passage in the circumferential direction becomes narrow. In the inline axial flow fan 100 of the example embodiment, the space 100B has narrow portions 105 at four locations in the circumferential direction.

While the airflow between the space 100A and the space 100B is suppressed by the flange 30, the space 100B is circumferentially connected over one lap on the outer side of the second case 22. Hence, an airflow occurs in the circumferential direction in the space 100B. When air flows in a wide range in the circumferential direction outside the second case 22, the air discharged from some of the second slits 22B flows around the outside of the second case 22 in the circumferential direction, whereby circulating air flowing into the second case 22 from the other second slits 22B occurs. Such circulating air is not used as the airflow F of the inline axial flow fan 100, and therefore causes reduction in the static pressure characteristics of the inline axial flow fan 100.

In the example embodiment, narrow portions 105 are provided in multiple locations in the circumferential direction of the space 100B in order to suppress the circulating air in the circumferential direction. The space 100B is partitioned into four spaces 101, 102, 103, and 104 in the circumferential direction by four narrow portions 105. As a result, for example, the circumferential flow of air discharged into the space 101 from the second slits 22B is inhibited by the narrow portion 105, hardly flows into the adjacent space 102 or space 104, and is sucked into the wind tunnel from the second slits 22B in the vicinity of the narrow portion 105.

As described above, in the inline axial flow fan 100 of the example embodiment, since air is circulated in the four spaces 101 to 104 partitioned in the circumferential direction outside the second case 22, it is possible to suppress generation of circulating air flowing in the circumferential direction outside the second case 22. Hence, according to the example embodiment, a high static pressure inline axial flow fan 100 is obtained.

Note that while the operational effect of the narrow portion 105 in the space 100B on the second fan 20 side has been described in the above description, the same operational effect can also be obtained in the space 100A on the first fan 10 side. The second case 22 and the main body portion 51 may be in contact with each other in the narrow portion 105.

The inventor has verified the noise reduction by the configuration of the example embodiment. It has been confirmed that as compared with an inline axial flow fan having a conventional configuration that does not include the first slits 12B, the second slits 22B, and the flange 30, the inline axial flow fan 100 of the example embodiment can achieve noise reduction of not less than 1.5 dB under conditions with which an equivalent air volume can be obtained.

While the first fan 10, the second fan 20, and the flange 30 are accommodated in the housing 50 in the configuration of the above example embodiment, the inline axial flow fan 100 may be configured not to include the housing 50. Even in this case, the flange 30 is disposed between a space radially outward of the first case 12 and a space radially outward of the second case 22 in the axial direction. Hence, it is possible to restrain the air discharged from the second slits 22B from flowing into the first case 12 from the first slits 12B. As a result, noise of the inline axial flow fan 100 can be reduced.

In the inline axial flow fan 100, one of the first impeller 10A and the second impeller 20A may be replaced with an impeller having an opposite air blowing direction to form a counter-rotating fan that rotates the first impeller 10A and the second impeller 20A in opposite directions. By using a counter-rotating fan, it is possible to achieve a higher static pressure and a larger air volume than an inline axial flow fan in which two impellers rotate in the same direction.

Figure 5:
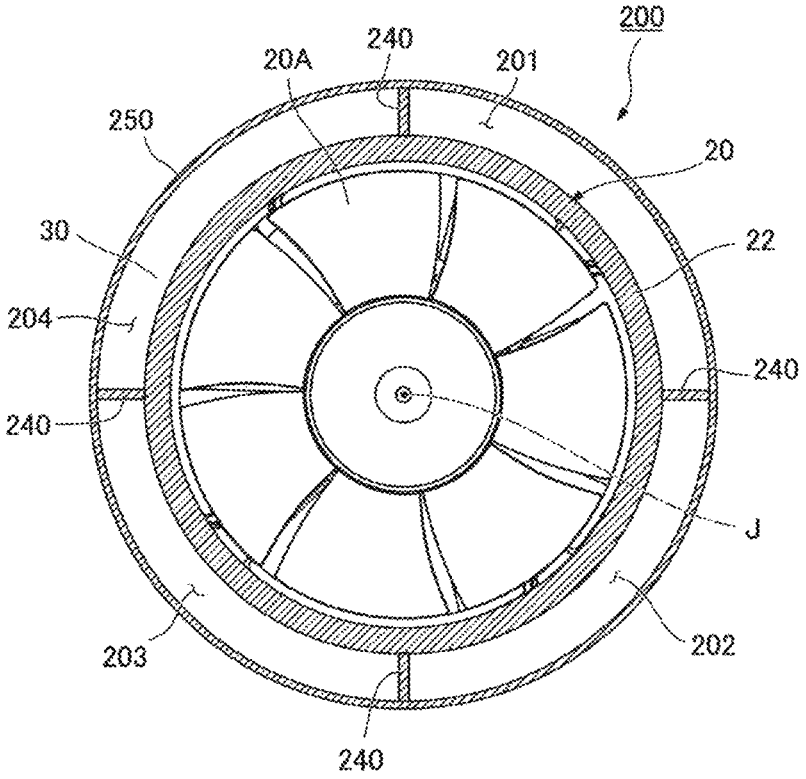
FIG. 5 is a cross-sectional view of an inline axial flow fan of a modification of an example embodiment of the present disclosure.

FIG. 5 is a cross-sectional view of an inline axial flow fan 200 of a modification. The inline axial flow fan 200 includes a cylindrical housing 250 that accommodates a first fan 10 and a second fan 20 similar to those of the above-described example embodiment.

The inline axial flow fan 200 has a disk-shaped flange 30 that extends radially outward from an outer peripheral surface of the first case 12 or the second case 22 at an intermediate position in the axial direction between the first fan 10 and the second fan 20. That is, the inline axial flow fan 200 is configured such that the housing 250 has a cylindrical shape extending in the axial direction, and the first case 12 and the second case 22 are cylindrical at least in a part from the first slits 12B to the second slits 22B in the axial direction.

Moreover, the inline axial flow fan 200 has multiple second partition plates 240 that are bridged between an inner peripheral surface of the housing 250 and an outer peripheral surface of the second case 22 in the radial direction. The inline axial flow fan 200 of the example embodiment has four second partition plates 240 that are arranged at 90-degrees intervals in the circumferential direction. The number of second partition plates 240 is not particularly limited. Note that although illustration is omitted, the inline axial flow fan 200 has multiple first partition plates extending radially from an outer peripheral surface of the first case 12 to an inner peripheral surface of the housing 250 outside the lower first case 12.

The four second partition plates 240 shown in FIG. 5 divide a space surrounded by the housing 250, the second case 22, and the flange 30 into four spaces 201, 202, 203, and 204 in the circumferential direction. The second partition plate 240 blocks circulation of air in the circumferential direction between the adjacent spaces 201 and 202. Similarly to the second partition plate 240, the multiple first partition plates provided on the outer periphery side of the first case 12 also divide a space radially outward of the first case 12 into multiple spaces arranged in the circumferential direction.

According to the inline axial flow fan 200 of the modification, the space radially outward of the second case 22 is divided into four spaces 201 to 204 by the multiple second partition plates 240. As a result, the air discharged to the space 201 outside the second case 22 from the second slits 22B can be prevented from flowing to the adjacent spaces 202 and 204 through the outside of the second case 22, for example.

Hence, according to the inline axial flow fan 200 of the modification, it is possible to suppress generation of circulating air in the circumferential direction outside the second case 22, so that reduction in the static pressure characteristics due to circulating air can be suppressed. As a result, according to the inline axial flow fan 200, both low noise and high static pressure can be achieved.

Note that the first partition plate and the second partition plate 240 may be provided in the inline axial flow fan 100 shown in FIGS. 1 to 4. For example, a second partition plate 240 extending in the radial direction may be provided in the narrow portion 105 shown in FIG. 4. According to this configuration, in the inline axial flow fan 100, the circulation of air in the circumferential direction through the narrow portion 105 can be further reduced. As a result, the decrease in static pressure is further suppressed, which also contributes to noise reduction.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An inline axial flow fan, comprising:

a first fan including a first impeller that is rotatable about a central axis, a first motor portion that rotates the first impeller, and a first case that surrounds an outer periphery of the first impeller;

a second fan including a second impeller that is rotatable about a central axis, a second motor portion that rotates the second impeller, and a second case that surrounds an outer periphery of the second impeller; and a housing that accommodates the first case and the second case; wherein the first fan and the second fan is positioned in sequence from one axial side of the inline axial flow fan to another axial side of the inline axial flow fan;

the first case includes a plurality of first slits located radially outward of the first impeller;

the second case includes a plurality of second slits located radially outward of the second impeller;

the plurality of first slits are arranged along a circumferential direction of a peripheral wall portion of the first case;

the plurality of second slits are arranged along a circumferential direction of a peripheral wall portion of the second case;

the inline axial flow fan includes a flange extending radially outward from an outer peripheral surface of the first case or the second case in an axial direction;

the flange is located between an axial side end of the plurality of first slits and an axial side end of the plurality of second slits;

the flange divides an axially extending hollow space between the first case and the second case within the housing;

the flange is defined by a structure which is separate from structures defining both of the first case and the second case, an inner peripheral surface of the flange is in contact with an outer peripheral surface of the first case or an outer peripheral surface of the second case, an outer peripheral surface of the flange is in contact with an inner peripheral surface of the housing, and the flange is structured such that an axial position of the flange is adjustable up and down axially to locations between the plurality of first slits and the plurality of second slits; and portions of the hollow space are provided directly radially between opposing surfaces of the housing and the first case and the second case.

2. The inline axial flow fan according to claim 1, wherein the housing has a rectangular tube shape extending in the axial direction; and the first case and the second case are cylindrical at least from the plurality of first slits to the plurality of second slits in the axial direction.

3. The inline axial flow fan according to claim 1, wherein the housing has a cylindrical shape extending in the axial direction; and the first case and the second case are cylindrical at least from the plurality of first slits to the plurality of second slits in the axial direction.

4. The inline axial flow fan according to claim 1, further comprising:

a partition plate that partitions a space between an outer peripheral surface of the first case and an inner peripheral surface of the housing into a plurality of spaces in a circumferential direction; and a partition plate that partitions a space between an outer peripheral surface of the second case and the inner peripheral surface of the housing into a plurality of spaces in the circumferential direction.

5. The inline axial flow fan according to claim 1, wherein the inline axial flow fan is a counter-rotating fan in which the first impeller and the second impeller are rotated in opposite directions.

6. The inline axial flow fan according to claim 1, wherein the housing includes a first opening on one axial side and a second opening on the other axial side, and includes an air filter in at least one of the first opening and the second opening.

7. The inline axial flow fan according to claim 1, wherein the portions of the hollow space are provided directly radially between the opposing surfaces of the housing and the first case and the second case about entire circumferences of the first case and the second case.

* * * * *